US012687177B2

(12) United States Patent
Dong et al.

(10) Patent No.: US 12,687,177 B2
(45) Date of Patent: Jul. 21, 2026

(54) FAN BLADE AND NECK FAN

(71) Applicant: SHENZHEN SHIWU TECHNOLOGY CO., LTD., Shenzhen (CN)

(72) Inventors: Haibo Dong, Shenzhen (CN); Xiangyu Yang, Shenzhen (CN); Hui Liu, Shenzhen (CN)

(73) Assignee: SHENZHEN SHIWU TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 18/983,623

(22) Filed: Dec. 17, 2024

(65) Prior Publication Data

US 2025/0116279 A1 Apr. 10, 2025

Related U.S. Application Data

(63) Continuation-in-part of application No. 18/211,111, filed on Jun. 16, 2023, now Pat. No. 12,504,023.

(30) Foreign Application Priority Data

Jun. 17, 2022 (CN) ..... 202221526916.7

(51) Int. Cl.
*F04D 25/08* (2006.01)
*F04D 29/28* (2006.01)
*F04D 29/66* (2006.01)

(52) U.S. Cl.
CPC ..... *F04D 29/666* (2013.01); *F04D 25/08* (2013.01); *F04D 29/281* (2013.01); *F04D 29/662* (2013.01)

(58) Field of Classification Search
CPC ..... F04D 25/08; F04D 29/666; F04D 29/662; F04D 29/281
See application file for complete search history.

(56) References Cited

U.S. PATENT DOCUMENTS

| | | | | |
|---|---|---|---|---|
| 7,241,110 | B2 * | 7/2007 | Chang | F04D 25/0613 415/206 |
| 9,624,932 | B2 * | 4/2017 | Jeon | F04D 29/30 |
| 2017/0298950 | A1 * | 10/2017 | Ling | F04D 29/4226 |
| 2017/0370596 | A1 * | 12/2017 | Lee | A42B 3/286 |
| 2018/0064574 | A1 * | 3/2018 | Adair | A61F 7/02 |
| 2019/0120252 | A1 * | 4/2019 | Wang | F04D 29/388 |

* cited by examiner

*Primary Examiner* — Michael L Sehn
(74) *Attorney, Agent, or Firm* — HOWARD M COHN and Associates, LLC

(57) ABSTRACT

Provided are a fan blade and a neck fan. The fan blade comprises a base, a plurality of outer blades, and a plurality of inner blades. The base is generally circular and protrudes in the middle, including an annular outer disc, a connecting cylinder, and a circular inner disc. The outer disc is annularly arranged on the outside of the bottom end of the connecting cylinder, and the inner disc seals the top end of the connecting cylinder. The inner disc is used for connecting the output shaft of the driving mechanism. The outer blades are annularly arranged on the outside of the outer disc, and the inner blades are annularly arranged on the outside of the inner disc, so that both the outer blades and the inner blades are located on the same side of the base, and the outer blades and the inner blades are spaced apart.

8 Claims, 5 Drawing Sheets

FAN BLADE AND NECK FAN

TECHNICAL FIELD

The present disclosure relates to the field of portable fans, in particular to a fan blade and a neck fan.

BACKGROUND

In the hot summer, when people go out, cool wind can take away heat and make people feel comfortable and pleasant. The neck fan perfectly meets the needs of customers. It can not only meet the demand for blowing air but also free users' hands and is convenient and portable.

Among them, the fan assembly is an important part of the neck fan. It can rotate under the drive of the motor to blow air to the user. However, when the fan blade is in working condition, the wind noise is relatively large, which affects the user's experience.

SUMMARY

In view of this, the purpose of the present disclosure is to overcome the problem that the fan in the prior art has large noise and affects the user experience.

The present application provides a fan blade. The fan blade comprises a base, a plurality of outer blades, and a plurality of inner blades. The base is generally circular and protrudes in the middle, including an annular outer disc, a connecting cylinder, and a circular inner disc. The outer disc is annularly arranged on the outside of the bottom end of the connecting cylinder, and the inner disc seals the top end of the connecting cylinder. The inner disc is used for connecting the output shaft of the driving mechanism. The outer blades are annularly arranged on the outside of the outer disc, so that both the outer blades and the inner blades are located on the same side of the base. The inner blades are annularly arranged on the outside of the inner disc, and the outer blades and the inner blades are spaced apart.

Optionally, the top of the outer blade is higher than the top of the connecting cylinder, and the top of the outer blade is flush with the top of the inner blade.

Optionally, the plurality of outer blades are evenly spaced and distributed on the outer disc, and the plurality of inner blades are evenly distributed on the inner disc.

Optionally, the number of outer blades is greater than that of inner blades, and the ratio of the number of outer blades to the number of inner blades ranges from 1.1 to 2.

Optionally, both the outer blades and the inner blades are arc-shaped and curved in the same circumferential direction. The curvature of the outer blade is greater than that of the inner blade.

Optionally, a part of the top of the side of the outer blade facing the inner disc is inclined downward, and the low point of the inclined side of the top of the outer blade is higher than the bottom of the inner blade.

Optionally, the ratio of the height of the outer blade to the height of the inner blade is 4-6. The ratio of the width of the outer blade to the width of the inner blade is 1.5-2.

Optionally, the side of the outer disc facing the connecting cylinder is smoothly rising.

The present application also discloses a neck fan, including a main body, a driving mechanism, and the fan blade as described above. The main body is U-shaped. Both ends of the U-shaped main body are provided with air inlet chambers. The fan blade is placed in the air inlet chamber. The side of the main body facing outward is provided with an air inlet corresponding to the air inlet chamber. The driving mechanism is installed in the connecting cylinder and is used for driving the fan blade to rotate.

Optionally, the main body is provided with an air outlet in the upward direction, and a wind tunnel is arranged below the air outlet. A section of the wind tunnel near the air inlet chamber is enlarged in the direction towards the air inlet chamber.

The present application reduces the degree of vortex generated when the fan blade works and lowers the noise by designing the above fan blade, thus providing a better user experience.

To make the above objects, features, and advantages of the present disclosure more obvious and understandable, the following describes preferred embodiments in detail with reference to the accompanying drawings.

DESCRIPTION OF DRAWINGS

To illustrate the technical solutions of the embodiments of the present disclosure more clearly, the following briefly introduces the accompanying drawings that need to be used in the embodiments. It should be understood that the following drawings only show some embodiments of the present disclosure and therefore should not be regarded as limiting the scope. For those of ordinary skill in the art, other relevant drawings can be obtained according to these drawings without creative efforts.

DESCRIPTION OF REFERENCE NUMBERS

Figure 1:
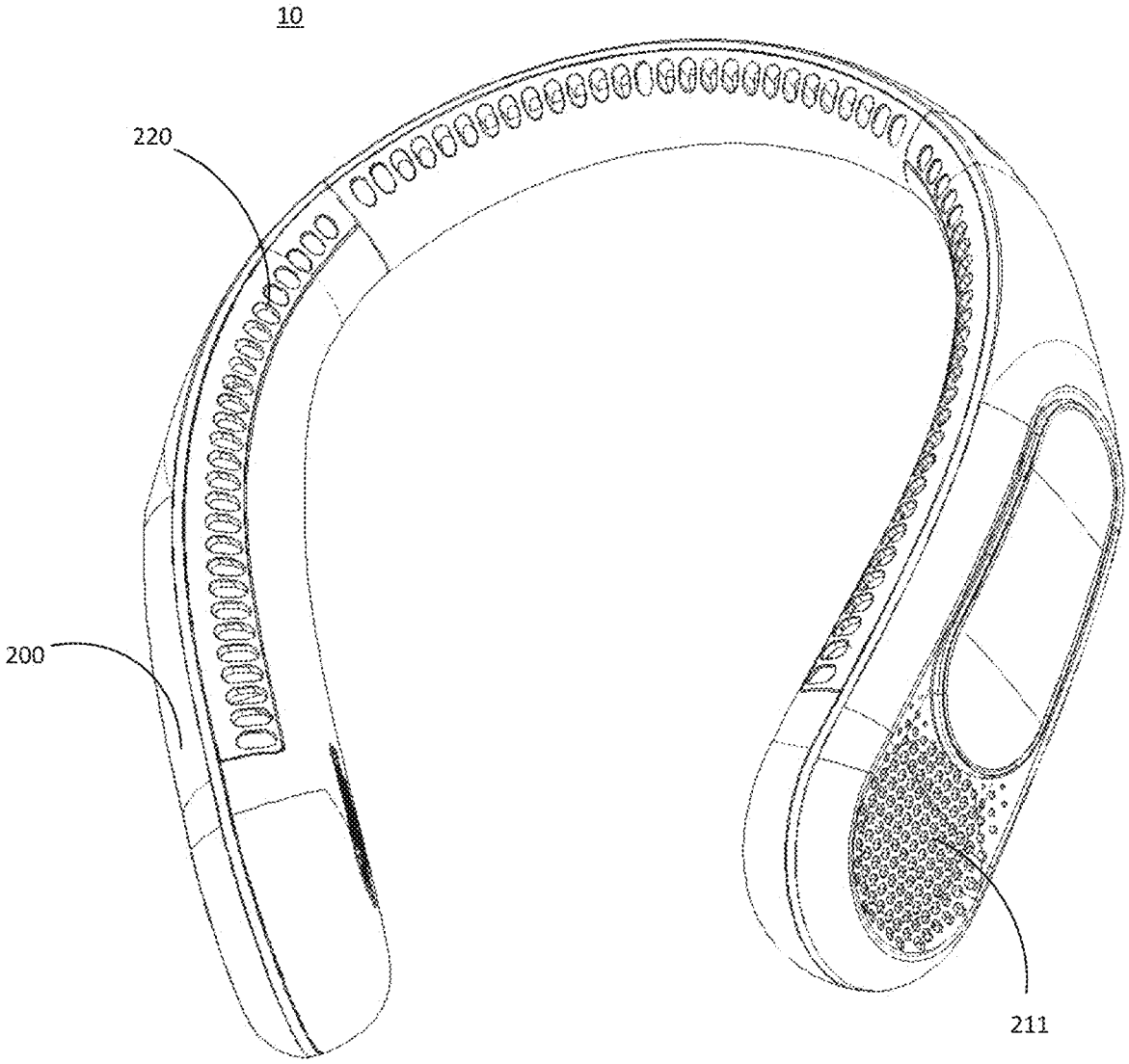
FIG. 1 is a schematic view of a neck fan from one angle in the present application.

Neck fan 10, Fan blade 100, Base 110, Outer disc 111, Connecting cylinder 112, Inner disc 113, Outer blade 120, Inner blade 130, Main body 200, Air inlet chamber 210, Air inlet 211, Air outlet 220, Wind tunnel 230.

The realization of the objective, functional features and advantages of the present disclosure will be further described with reference to the accompanying drawings in conjunction with the embodiments.

DESCRIPTION OF EMBODIMENTS

The embodiments of the present disclosure are described in detail below. The examples of the embodiments are shown in the accompanying drawings, in which the same or similar reference numerals indicate the same or similar elements or elements with the same or similar functions. The embodiments described below with reference to the accompanying drawings are exemplary and are only used to explain the present disclosure and cannot be construed as limiting the present disclosure.

It should be noted that when an element is referred to as being "fixed to" another element, it can be directly on the other element or there can also be an intervening element. When an element is considered to be "connected" to another element, it can be directly connected to the other element or there may also be an intervening element at the same time.

Conversely, when an element is described as being "directly on" another element, there is no intervening element. The terms "vertical", "horizontal", "left", "right", and similar expressions used herein are only for the purpose of illustration.

In the present disclosure, unless otherwise expressly specified and limited, the terms "installation", "connection", "connection", "fixation", and the like should be understood in a broad sense. For example, it can be a fixed connection, a detachable connection, or an integral connection; it can be a mechanical connection or an electrical connection; it can be a direct connection or an indirect connection through an intermediate medium, and it can also be the internal communication of two elements or the interaction relationship between two elements. For those of ordinary skill in the art, the specific meanings of the above terms in the present disclosure can be understood according to specific situations.

In addition, the terms "first" and "second" are only used for descriptive purposes and cannot be construed as indicating or implying relative importance or implicitly indicating the number of technical features indicated. Thus, the features defined with "first" and "second" may explicitly or implicitly include one or more of these features. In the description of the present disclosure, the meaning of "a plurality" is two or more, unless otherwise expressly and specifically defined.

Unless otherwise defined, all technical and scientific terms used herein have the same meaning as commonly understood by those skilled in the technical field to which this application belongs. The terms used in the description of the present disclosure are only for the purpose of describing specific embodiments and are not intended to limit the present disclosure. The term "and/or" used herein includes any and all combinations of one or more of the associated listed items.

Figure 3:
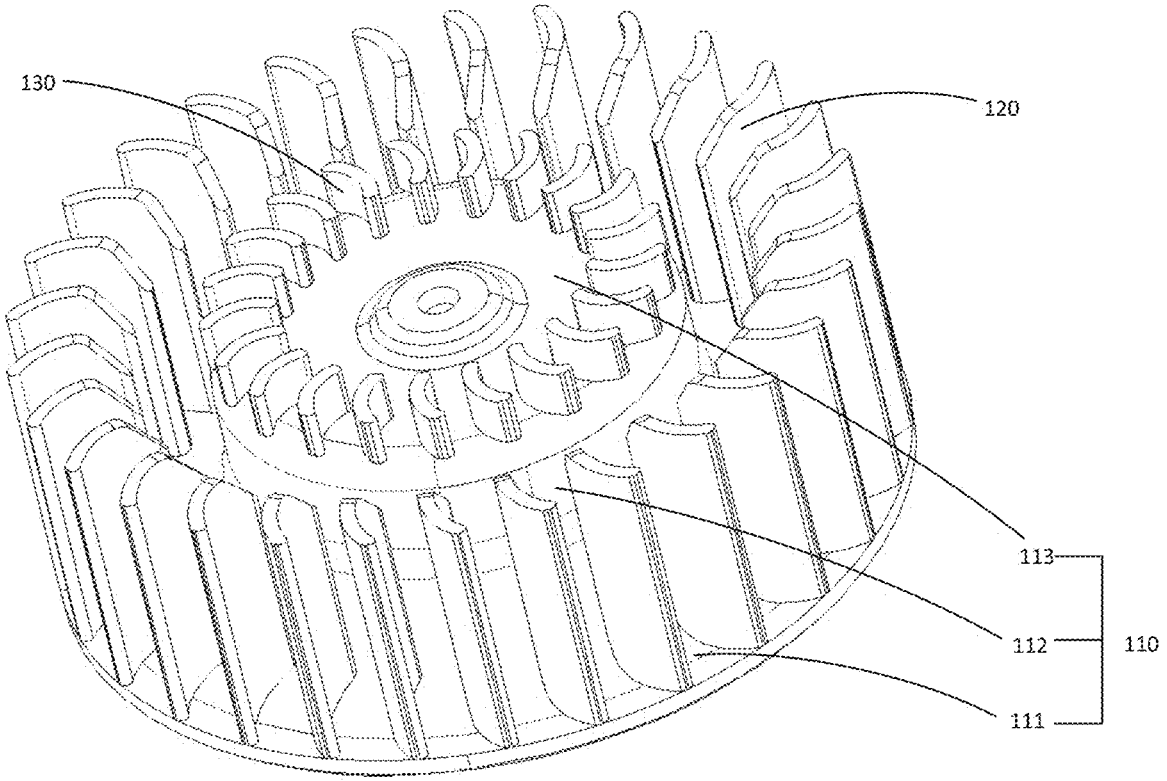
FIG. 3 is a schematic view of a fan blade in the present application.

As shown in FIGS. 1 and 3, the present application discloses a fan blade 100 and a neck fan 10.

Figure 4:
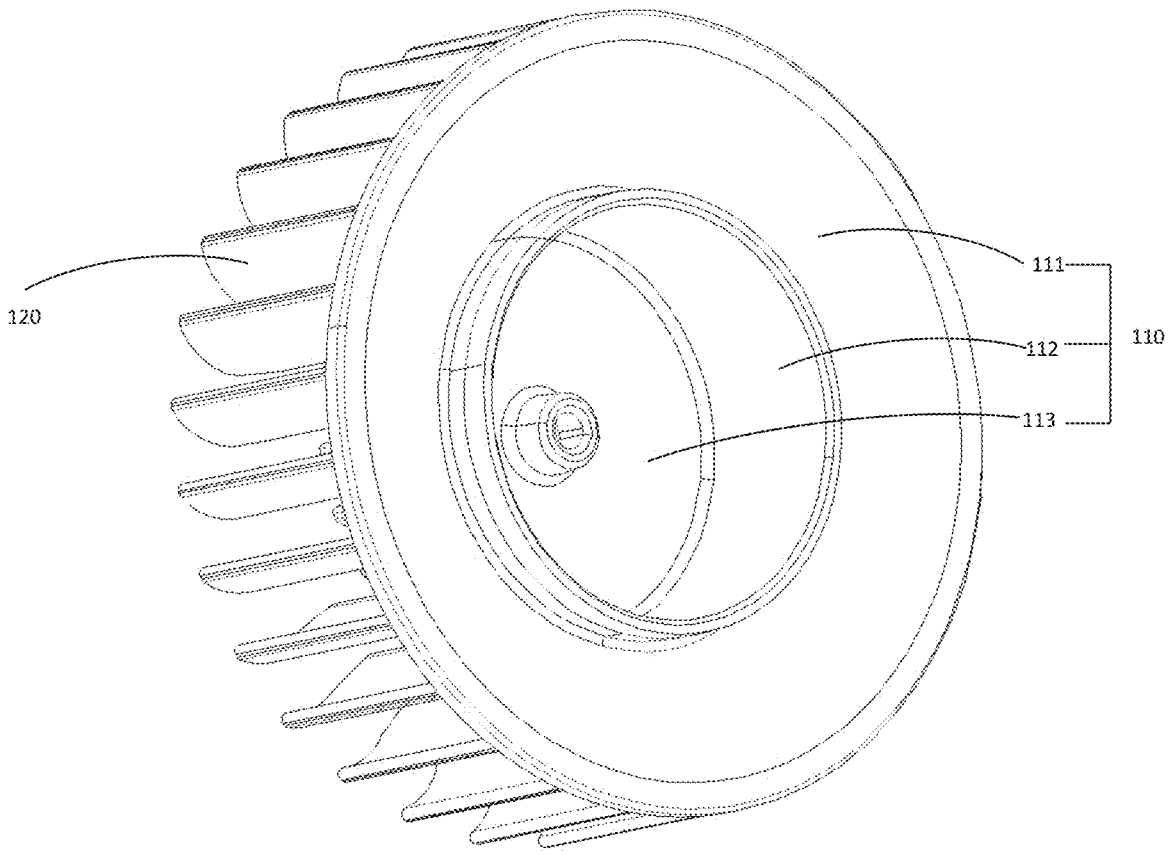
FIG. 4 is a schematic view of the fan blade in FIG. 3 from one angle.
Figure 5:
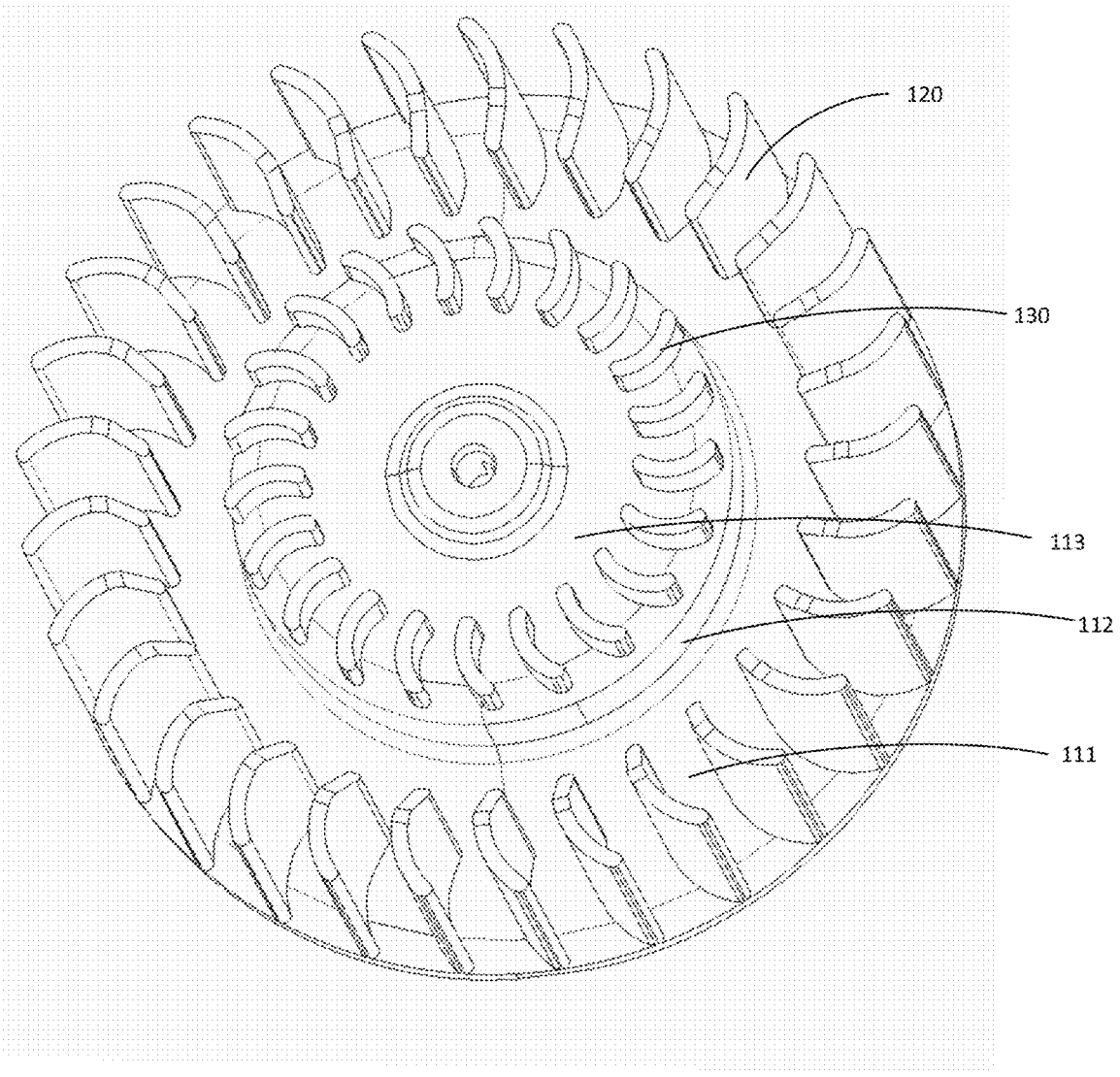
FIG. 5 is a schematic view of the fan blade in FIG. 3 from another angle.

As shown in FIGS. 3-5, the fan blade 100 comprises a base 110, a plurality of outer blades 120, and a plurality of inner blades 130. The base 110 is generally circular and protrudes in the middle, including an annular outer disc 111, a connecting cylinder 112, and a circular inner disc 113. The outer disc 111 is annularly arranged on the outside of the bottom end of the connecting cylinder 112, and the inner disc 113 seals the top end of the connecting cylinder 112. The inner disc 113 is used for connecting the output shaft of the driving mechanism. The outer blades 120 are annularly arranged on the outside of the outer disc 111, and the inner blades 130 are annularly arranged on the outside of the inner disc 113, so that both the outer blades 120 and the inner blades 130 are located on the same side of the base 110, and the outer blades 120 and the inner blades 130 are spaced apart.

By setting the fan blade 100 in the above state, both the inner blades 130 and the outer blades 120 are located on the same side of the base. When the fan blade 100 works, it drives the air flow to rotate and blow air on one side. Compared with the traditional blades with blades on both sides that drive the air flow to rotate on both sides, the one-sided air flow in the present application can avoid the disadvantage of the mutual disturbance of the air flow on both sides to form a vortex. At the same time, the inner blades 130 play a certain role in adjusting the air flow of the outer blades 120, reducing the degree of turbulence generated on the inner side when the outer blades 120 rotate, thereby reducing the noise generated when the fan blade 100 rotates and bringing a better user experience.

The top of the outer blade 120 is higher than the top of the connecting cylinder 112, and the top of the outer blade 120 is flush with the top of the inner blade 130. This can further improve the noise generated by the turbulence when the fan blade 100 works.

The plurality of outer blades 120 are evenly spaced and distributed on the outer disc 111, and the plurality of inner blades 130 are evenly distributed on the inner disc 113. Both the outer blades 120 and the inner blades 130 are evenly distributed, so that the air flow generated by rotation is more stable, thereby reducing turbulence and noise.

The number of outer blades 120 is greater than that of inner blades 130, and the ratio of the number of outer blades 120 to the number of inner blades 130 ranges from 1.1 to 2. In one embodiment, the ratio of the number of outer blades 120 to the number of inner blades 130 is 1.5. This can ensure the air volume and reduce noise to a certain extent.

Both the outer blades 120 and the inner blades 130 are arc-shaped and curved in the same circumferential direction. The curvature of the outer blade 120 is greater than that of the inner blade 130. This can play a better role in balancing the air flow and reducing noise.

A part of the top of the side of the outer blade 120 facing the inner disc 113 is inclined downward, and the low point of the inclined side of the top of the outer blade 120 is higher than the bottom of the inner blade 130. With this arrangement, the inner blades 130 and the outer blades 120 can cooperate better to balance the air flow between the inner and outer blades 120 and reduce noise.

The ratio of the height of the outer blade 120 to the height of the inner blade 130 is 4-6. The ratio of the width of the outer blade 120 to the width of the inner blade 130 is 1.5-2. This can ensure better cooperation between the outer blades 120 and the inner blades 130, reduce vortices, and reduce noise.

The side of the outer disc 111 facing the connecting cylinder 112 is smoothly rising. This can make the air flow between the outer blades 120 and the connecting cylinder 112 more stable, reduce vortices, and reduce the noise of the air flow rotation.

Figure 2:
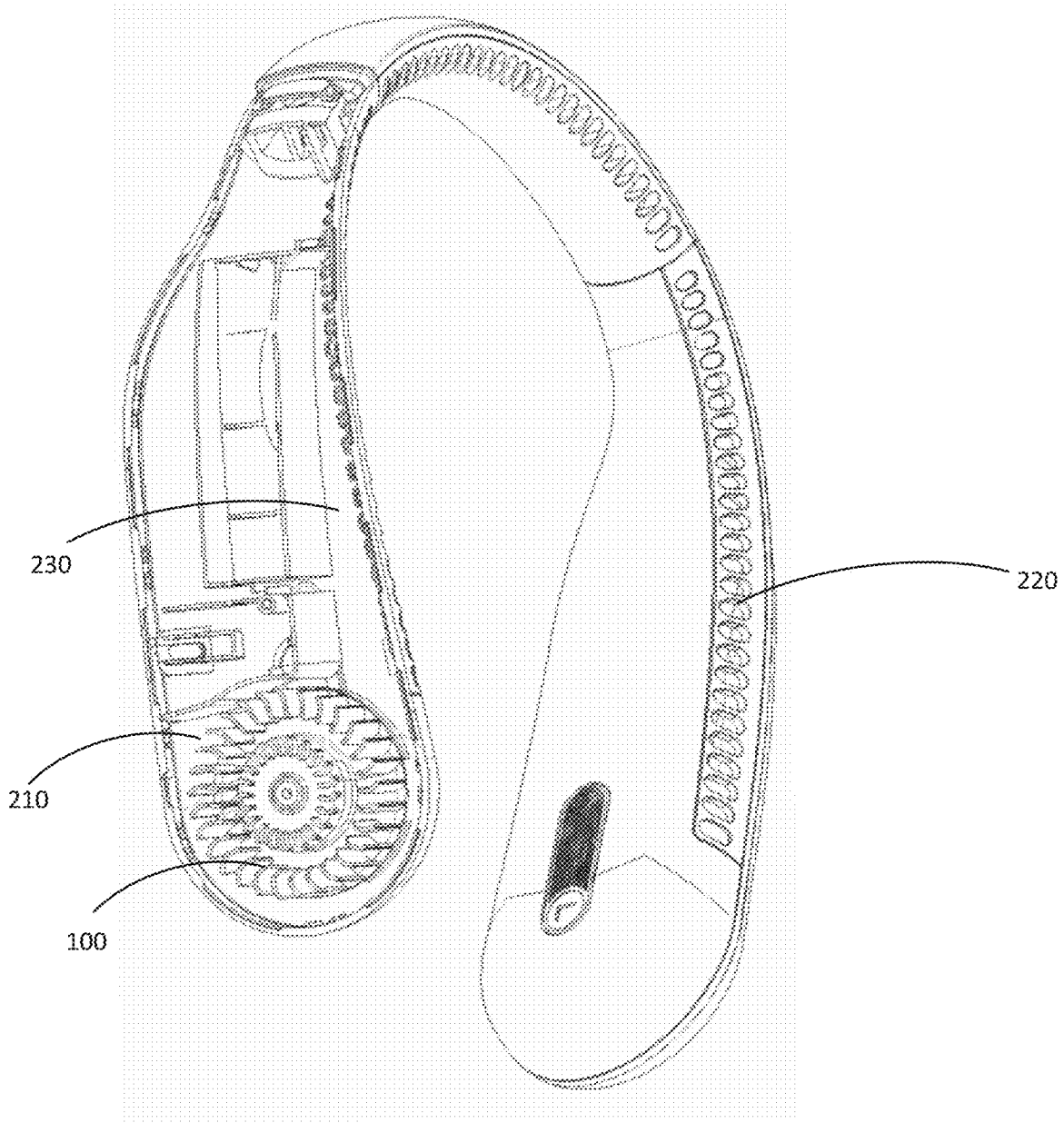
FIG. 2 is a schematic view of the neck fan in FIG. 1 with part of the housing removed.

As shown in FIGS. 1 and 2, the present application also discloses a neck fan 10. The main body 200 is U-shaped. Both ends of the U-shaped main body 200 are provided with air inlet chambers 210. The fan blade 100 is placed in the air inlet chamber 210. The side of the main body 200 facing outward is provided with an air inlet 211 corresponding to the air inlet chamber 210. The driving mechanism (not shown in the figure) is installed in the connecting cylinder 112 and is used for driving the fan blade 100 to rotate.

The main body 200 is U-shaped and can be easily hung around the user's neck, which is convenient for carrying. Among them, the driving mechanism is a motor, and the motor is placed in the connecting cylinder 112 to achieve efficient use of space. When the fan blade 100 rotates, the outside air is sucked into the air inlet chamber 210 through the air inlet 211, and then flows out in the main body 200 to bring cool breeze to the user. Among them, the structure design of the fan blade 100 is the same as that of the above fan blade, so that the noise during work is relatively small and provides a better user experience.

The main body 200 is provided with an air outlet 220 in the upward direction, and a wind tunnel 230 is arranged below the air outlet 220. A section of the wind tunnel 230 near the air inlet chamber 210 is enlarged in the direction towards the air inlet chamber 210. A section of the wind tunnel 230 near the air inlet chamber 210 is contracted. The side of the wind tunnel 230 near the air inlet chamber 210 is relatively large, and the side slightly away from the air inlet chamber 210 is smaller. This is beneficial for the fan blade 100 to introduce the air flow into the wind tunnel 230 and to reduce noise.

The above descriptions are merely preferred embodiments of the present disclosure and are not intended to limit the patent scope of the present disclosure. Any equivalent structural changes made under the inventive concept of the present disclosure, or any direct or indirect application in other related technical fields, should be included in the scope of patent protection of the present disclosure.

The invention claimed is:

1. A neck fan, comprising a main body, a driving mechanism, and a fan blade;

wherein the fan blade comprises a base, a plurality of outer blades, and a plurality of inner blades;

wherein the base is circular and protrudes in the middle, including an annular outer disc, a connecting cylinder, and a circular inner disc, the outer disc is annularly arranged on an outside of a bottom end of the connecting cylinder, and the inner disc seals a top end of the connecting cylinder, and the inner disc is used for connecting an output shaft of the driving mechanism; and the plurality of outer blades are annularly arranged on the outside of the outer disc, and the plurality of inner blades are annularly arranged on the outside of the inner disc, so that both the plurality of outer blades and the plurality of inner blades are located on the same side of the base, and the plurality of outer blades and the plurality of inner blades are spaced apart;

wherein the main body is U-shaped, both ends of the U-shaped main body are provided with air inlet chambers, a fan blade is placed in the air inlet chamber, the side of the main body facing outward is provided with an air inlet corresponding to the air inlet chamber, and the driving mechanism is installed in the connecting cylinder and is used for driving the fan blade to rotate; and wherein the top of the plurality of outer blades is higher than the top of the connecting cylinder, and the top of the plurality of outer blades is flush with the top of the plurality of inner blades.

2. The neck fan according to claim 1, wherein the plurality of outer blades are evenly spaced and distributed on the outer disc, and the plurality of inner blades are evenly distributed on the inner disc.

3. The neck fan according to claim 1, wherein the number of the plurality of outer blades is greater than that of the plurality of inner blades, and the ratio of the number of the plurality of outer blades to the number of the plurality of inner blades ranges from 1.1 to 2.

4. The neck fan according to claim 1, wherein both the plurality of outer blades and the plurality of inner blades are arc-shaped and curved in the same circumferential direction; the curvature of the plurality of outer blades is greater than that of the plurality of inner blades.

5. The neck fan according to claim 1, wherein a part of the top of the side of the plurality of outer blades facing the inner disc is inclined downward, and the low point of the inclined side of the top of the plurality of outer blades is higher than the bottom of the plurality of inner blades.

6. The neck fan according to claim 1, wherein a side of the outer disc facing the connecting cylinder is rising.

7. The neck fan according to claim 1, wherein the main body is provided with an air outlet in the upward direction, and a wind tunnel is arranged below the air outlet;

and a section of the wind tunnel near the air inlet chamber is enlarged in the direction towards the air inlet chamber.

8. A neck fan, comprising:

a main body, a driving mechanism, and a fan blade;

wherein the fan blade comprises a base, a plurality of outer blades, and a plurality of inner blades;

wherein the base is circular and protrudes in the middle, including an annular outer disc, a connecting cylinder, and a circular inner disc, the outer disc is annularly arranged on an outside of a bottom end of the connecting cylinder, and the inner disc seals a top end of the connecting cylinder, and the inner disc is used for connecting an output shaft of the driving mechanism; and the plurality of outer blades are annularly arranged on the outside of the outer disc, and the plurality of inner blades are annularly arranged on the outside of the inner disc, so that both the plurality of outer blades and the plurality of inner blades are located on the same side of the base, and the plurality of outer blades and the plurality of inner blades are spaced apart;

wherein the main body is U-shaped, both ends of the U-shaped main body are provided with air inlet chambers, the fan blade is placed in the air inlet chamber, a side of the main body facing outward is provided with an air inlet corresponding to the air inlet chamber, and the driving mechanism is installed in the connecting cylinder and is used for driving the fan blade to rotate; and the ratio of the height of the plurality of outer blades to the height of the plurality of inner blades is 4-6; and the ratio of the width of the plurality of outer blades to the width of the plurality of inner blades is 1.5-2.

* * * * *